US009193171B2

(12) United States Patent
Moore et al.

(10) Patent No.: US 9,193,171 B2
(45) Date of Patent: Nov. 24, 2015

(54) CHEMICALLY REACTIVE TEST STRIP FOR DETECTING MIS-FIRING PRINT HEADS WITH CLEAR FLUIDS

(71) Applicant: XEROX CORPORATION, Norwalk, CT (US)

(72) Inventors: Aaron M. Moore, Fairport, NY (US); Timothy G. Shelhart, West Henrietta, NY (US); Roberto A. Irizarry, Rochester, NY (US); Carlos M. Terrero, Ontario, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/178,608

(22) Filed: Feb. 12, 2014

(65) Prior Publication Data

US 2015/0224788 A1 Aug. 13, 2015

(51) Int. Cl.
*B41J 29/38* (2006.01)
*B41J 2/21* (2006.01)

(52) U.S. Cl.
CPC ..... *B41J 2/2132* (2013.01)

(58) Field of Classification Search
CPC ..... B41J 29/393
USPC ..... 347/14; 436/174, 514
See application file for complete search history.

(56) References Cited

U.S. PATENT DOCUMENTS

| | | | | |
|---|---|---|---|---|
| 5,053,339 | A * | 10/1991 | Patel | 436/2 |
| 5,449,898 | A * | 9/1995 | Dosmann | 250/208.1 |
| 2003/0104510 | A1 * | 6/2003 | Yu | 435/25 |
| 2008/0261326 | A1 * | 10/2008 | Dudenhoefer et al. | 436/174 |
| 2011/0116123 | A1 * | 5/2011 | Mizes et al. | 358/1.15 |

* cited by examiner

*Primary Examiner* — Julian Huffman
*Assistant Examiner* — Sharon A Polk
(74) *Attorney, Agent, or Firm* — MH2 Technology Law Group LLP

(57) ABSTRACT

A jetting-fault analysis system can include a print head with a plurality of nozzles for ejecting a print medium, a testing substrate that can include a carrier and at least one color-changing material that changes color and forms a color pattern upon exposure to at least one color-change inducer, an applicator for delivering a color-change inducer to the testing substrate, and a color-pattern imaging system for analyzing the color pattern.

19 Claims, 6 Drawing Sheets

CHEMICALLY REACTIVE TEST STRIP FOR DETECTING MIS-FIRING PRINT HEADS WITH CLEAR FLUIDS

FIELD

Embodiments described herein relate generally to the field of printing, particularly 3D printing, and specifically to the field of nozzle fault analysis in 3D printer multi-nozzle print heads.

BACKGROUND

Some 3D printers require continuous operation in excess of several hours to several days in order to complete a single print job. To verify quality after the print job is completed, the printed part may be scanned, for example, via X-ray, for voids caused by misfiring or non-firing jets/nozzles (i.e., an unacceptable jet failure) from the print head. This quality check can add more time required to fully complete a print job. If voids, such as those caused by failed jets/nozzles, are detected, the part must be discarded and a new part must be made.

It would be beneficial to detect a jet/nozzle failure during a print job, or at least reduce the time to identify such a failure. However, when these kinds of voids form in the clear or semi-transparent inks/plastics/waxes that are sometimes used as jetted/printed material, they are difficult to identify. For example, the scanners and/or cameras used for quality analysis cannot distinguish a clear print-material pattern (such as a dot or another shape) on a test strip from a non-existent or mis-located pattern/dot.

Accordingly, conventional jetting fault-analysis systems and methods of detecting jetting faults are limited by the shortcomings of the scanners and cameras currently utilized for detecting voids which cannot detect faults in clear or transparent print materials. Additionally, conventional 3-D printing processes are limited by the long production times that are further lengthened by post-print fault analysis. What is needed in the art, therefore, is a jetting fault analysis system and method for detecting jetting faults for 3-D print jobs that utilize clear print materials, and can perform in situ fault analysis, instead of after a 3-D print job is completed, in order to shorten production times.

SUMMARY

In an embodiment, there is a jetting-fault analysis system. The jetting-fault analysis system can include a print head with a plurality of nozzles for ejecting a print medium, a testing substrate comprising a carrier and at least one color-changing material that changes color and forms a color pattern upon exposure to at least one color-change inducer, an applicator for deliveries a color-change inducer to the testing substrate, and a color-pattern imaging system for analyzing the color pattern.

In another embodiment there is a method for performing a jetting-fault analysis. The method can include forming a sample pattern on a testing substrate by ejecting a print medium from at least one of a plurality of nozzles of a print head onto the testing substrate. The testing substrate can include a carrier and at least one color-changing material. The method can also include forming a color pattern by exposing the at least one color-changing material of the substrate to at least one color-change inducer, wherein portions of the substrate underlying the sample pattern are not penetrated by the color-change inducer.

Advantages of at least one embodiment include forming highly visible color test patterns that can be easily analyzed and compared to expected color patterns, for example color patterns representing negative patterns of the deposited patterns. Another advantage of at least one embodiment includes faster times for completing a print-job due to in situ jet-fault analysis.

Additional advantages of the embodiments will be set forth in part in the description which follows, and in part will be understood from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

The following embodiments are described for illustrative purposes only with reference to the Figures. Those of skill in the art will appreciate that the following description is exemplary in nature, and that various modifications to the parameters set forth herein could be made without departing from the scope of the present embodiments. It is intended that the specification and examples be considered as examples only. The various embodiments are not necessarily mutually exclusive, as some embodiments can be combined with one or more other embodiments to form new embodiments.

Figure 1:
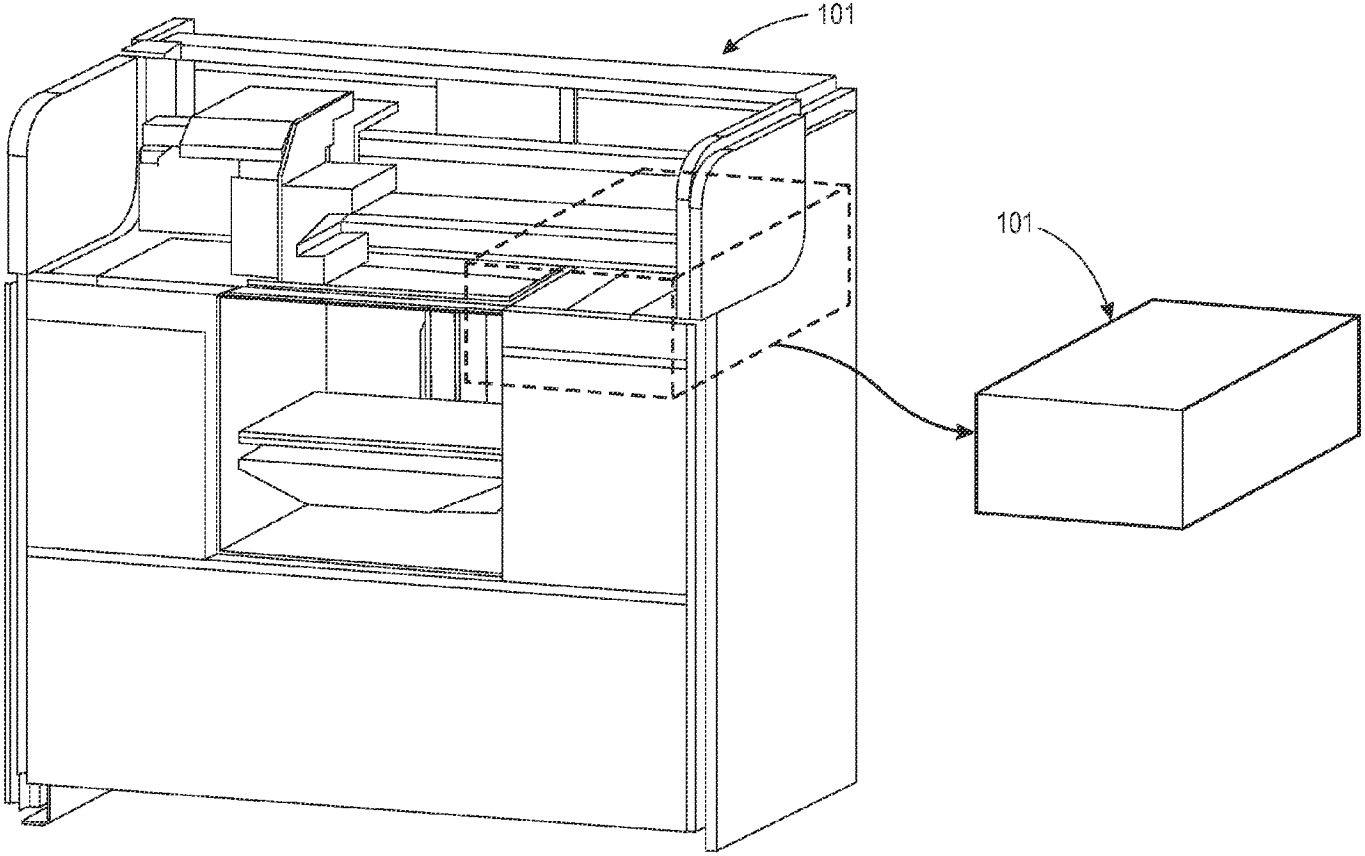
FIG. 1 is a cut-through image of a 3-D printer showing an exemplary location for a jet-fault analysis system of at least one embodiment therein.

As shown in FIG. 1, a 3-D printer 100 can include a test area location (for example, the location outlined by the dashed-lines) for a jet-fault analysis system 101. In an embodiment of a jet-fault analysis system, the printer's print head can be configured for moving to the test area and depositing (also called "jetting") a test pattern formed of print material ejected from the print head's nozzles (also called "jets") onto a testing substrate. The testing substrate can be a chemically treated test strip, such as a strip of paper in which a first chemical is present. The test strip can then be further treated with a second chemical. For example, the test strip can be moved under a roller that applies the second chemical onto exposed portions of the test strip (i.e., portions of the test strip not protected by the test pattern), for example. When the second chemical contacts the first chemical, the exposed/unprotected portions of the test strip change color. A color contrast thus exists between the exposed portions of the test strip relative to the protected portions of the test strip where print medium is deposited as the test pattern. In other words, the jet-fault analysis system introduces a color-change inducer chemical to the test strip that reacts with the first color-changing material in areas of the test strip not covered or protected by the test pattern of print medium and the while the protected/covered areas of the test strip do not change color.

For example, any jetted print material (which can be deposited in any shape, such as squares or dots) covering the test strip will block the second chemical, which can be a fluid, from coating the strip in that location, thus leaving that area untreated. As some areas of the underlying test strip are protected by the dots, the second chemical, which can be any color-change inducing material, only affects unprotected portions of the test strip. The result is a color pattern that comprises a highly visible color-contrast between the unprotected areas of the strip and the protected areas. The color pattern can be imaged/scanned and analyzed using known methods, such as with a camera/scanning system and associated logic for comparing photographed/scanned patterns to pre-stored, acceptable patterns.

In one embodiment there can be a white test strip which can be used as a testing substrate including a first chemical as a color-changing material, and a clear print medium deposited on portions of the substrate. Upon contacting the first chemical with a second chemical (a color-change inducer), they react and turn red. Thus, portions of the test strip covered by the print medium remain white while other areas surrounding the print medium turn red (i.e., a color pattern). The color pattern can be compared to an expected color pattern. The test strip can then be scanned/photographed/observed and compared to an expected color pattern. Those color patterns that substantially differ from the expected color pattern can be indicative of at least one jet failing to perform in an acceptable manner. Such poor jetting performance can include jets failing to fire, firing to the wrong location, or firing incorrect dot sizes (such as when a jet is partially clogged and it may only output a portion of the desired print material).

As illustrated in FIGS. 2A-2E, a jet-fault analysis system 101 can form and analyze an acceptable test pattern of print material. The jetting-fault analysis system 101 can include a print head 105. The print head 105 can be, for example, the print head of a 3D printer configured to move to the test area, such as the test area shown in FIG. 1. The print head 105 can include a plurality of nozzles (not visible) for ejecting a print medium, for example, onto a testing substrate 103, in any pattern, such as a test pattern 107.

Testing substrate 103 can comprise a matrix material, which can be referred to as a carrier, and at least one color-changing material dispersed throughout the carrier. The system can also include an applicator 111, such as a roller, a brush, a pad, a stamp or a combination thereof, to deliver the at least one color-change inducer to the testing substrate. The color-changing material can change color upon being activated. In one embodiment, the color-changing material is chemically activated by the color-change inducer. In another embodiment, the color-changing material is activated by an external source, such as heat. As a result, portions of the substrate 103 containing color-changing material can change color upon activation to form a colorized substrate. Thus color-contrast patterns can be formed between the colorized substrate and substrate that has not yet had its color-changing material activated to change color. A color-pattern imaging system 115 for imaging and analyzing patterns, such as color-contrast patterns, or color-patterns for short, can be integrated with the jet-fault analysis system. The color-pattern imaging system can include a camera connected to a computer.

Figure 2A:
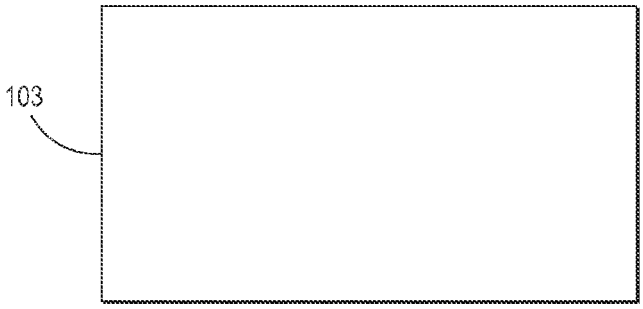
FIG. 2A-2E illustrates features of a jet-fault analysis system of an embodiment. The print head of a 3-D printer, such as that in FIG. 1, can operate normally to form an acceptable test pattern on a testing substrate.
Figure 2B:
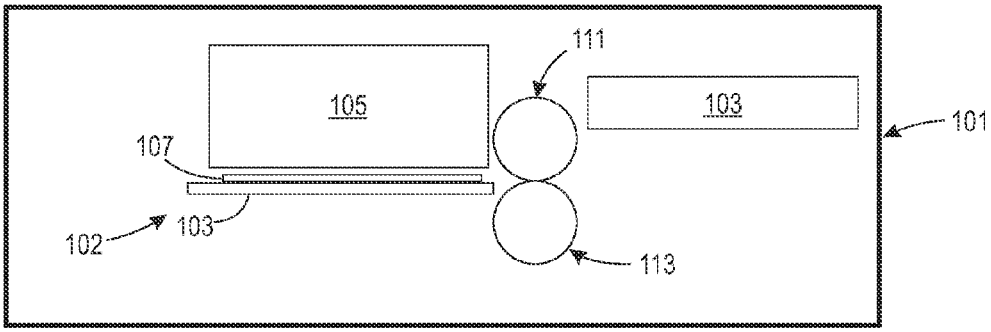
Figure 2C:
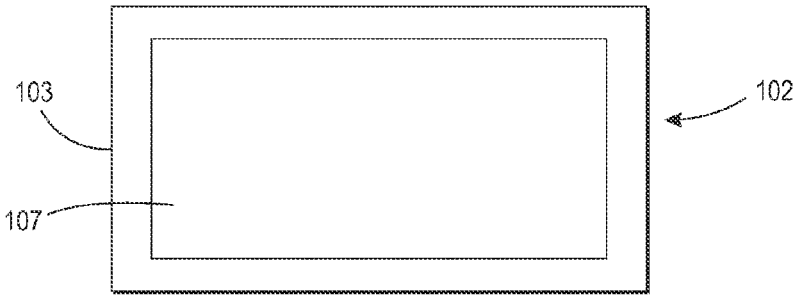
Figure 2D:
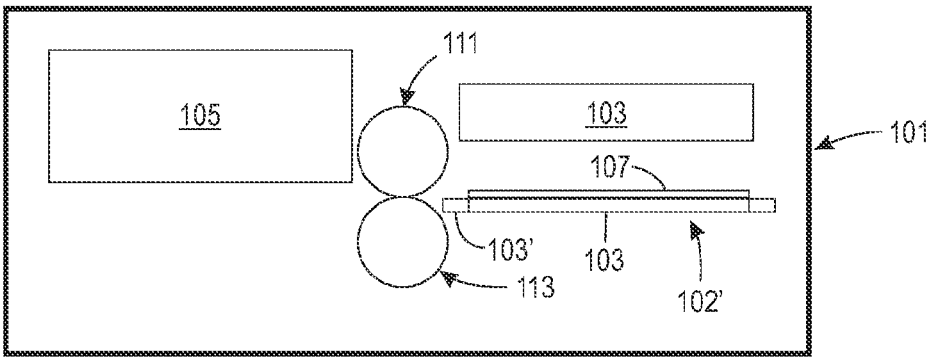
Figure 2E:
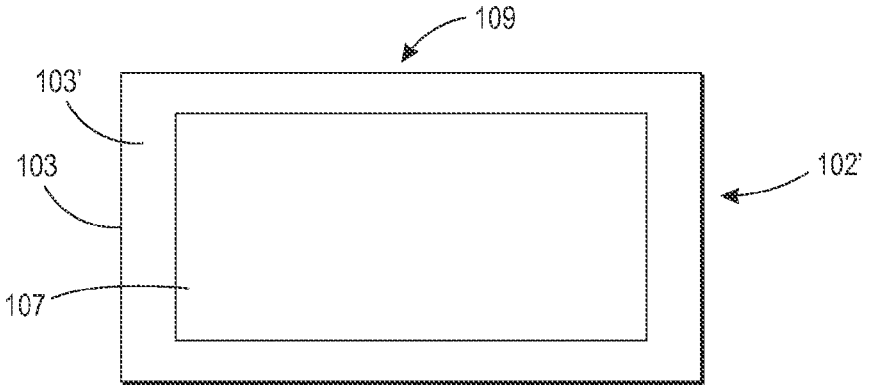
Figure 3A:
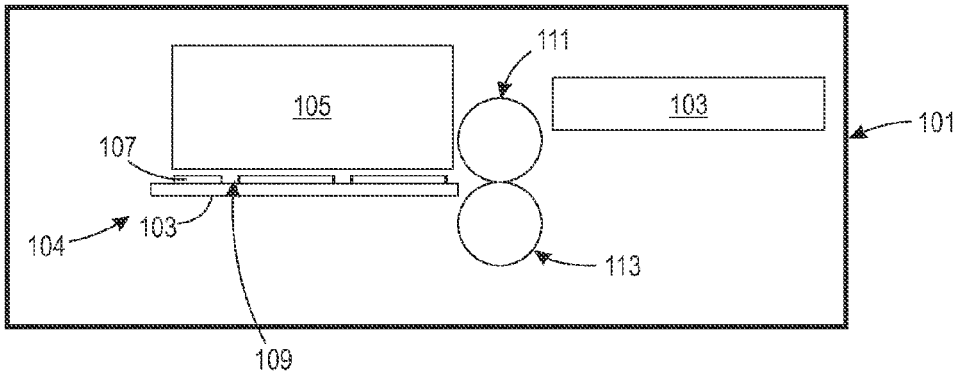
FIG. 3A-3D illustrates features of a jet-fault analysis system of an embodiment. The print head of a 3-D printer, such as that in FIG. 1, can suffer jet-faults (e.g., via fully or partially clogged nozzles) to form an unacceptable test pattern on a testing substrate.
Figure 3B:
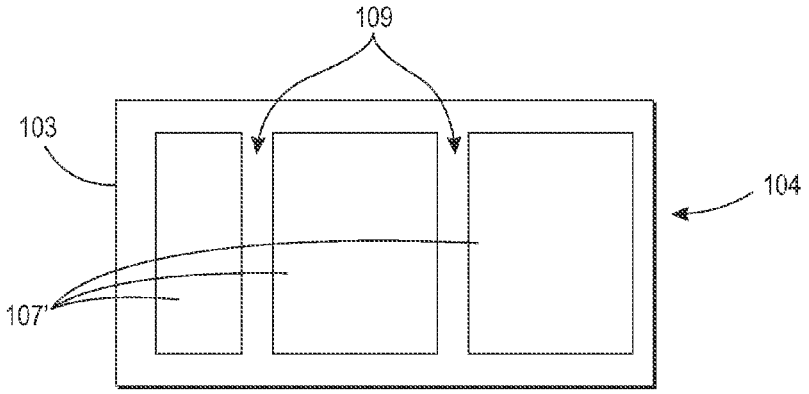
Figure 3C:
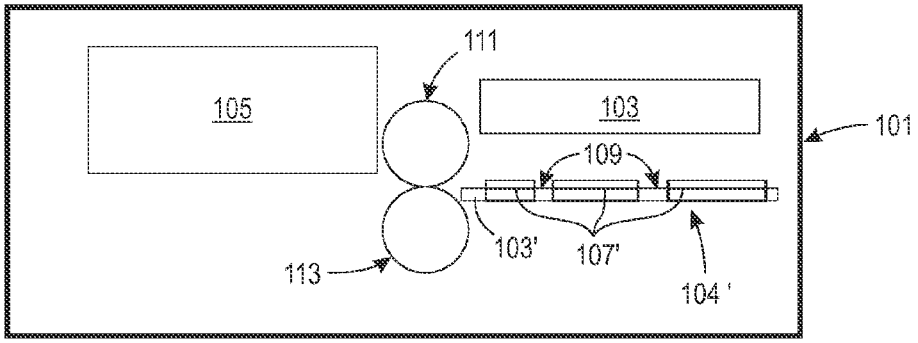
Figure 3D:
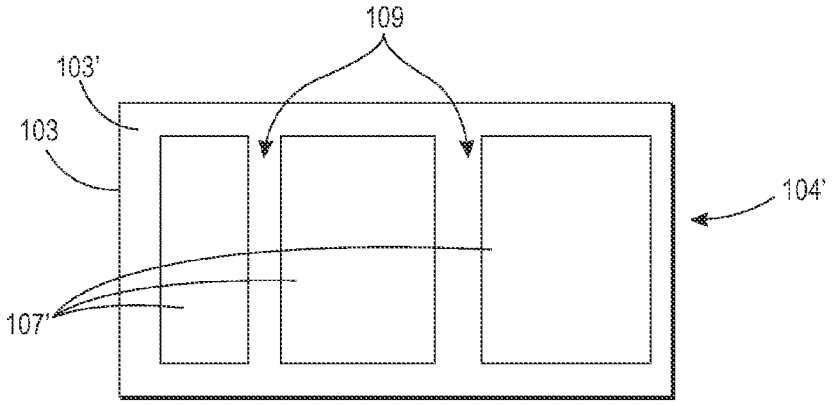

Optionally, the jet-fault analysis system can include a transporter, such as a roller 113, for moving the testing substrate. For example, the roller 113 can work in conjunction with the applicator 111 (which can be another roller), to both move and apply the color-change inducer to the substrate in a roll-to-roll configuration. Thus, the substrate can be moved automatically between the print head 105 to the color-pattern imaging system 115. As the color-change inducing material is applied to the substrate, unprotected portions 103' of the substrate (i.e., portions of the substrate not protected from the color-change inducing material by the test pattern) can change color via, for example, interaction between the color-change inducer and the color-changing material, as shown in FIG. 2E, thereby resulting in a color pattern 102'.

Figure 4:
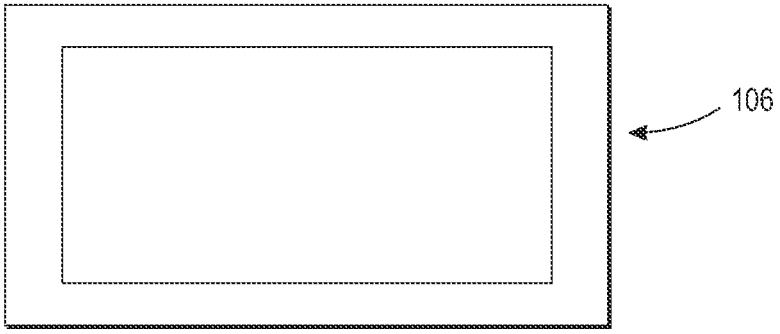
FIG. 4 illustrates an example of a reference color pattern that can be utilized for comparing a color pattern formed by a jet-fault analysis system of an embodiment.

The system 101 can also include at least one processor and at least one memory (not shown) to store data and instructions. The at least one processor can be configured to access the at least one memory and to execute instructions, for example, retrieve and execute instructions contained in the memory. The instructions can include instructions for causing the imaging system to scan or photograph the resulting color pattern 102'. The instructions can also include storing the photograph in the memory, and/or comparing the representation of the color pattern 102' of the photograph with an expected or predetermined color pattern, such as color pattern 106 illustrated in FIG. 4. In an embodiment, the photograph of the color test pattern can be compared digitally and automatically to the expected or predetermined test pattern. While not limited to any particular process, image comparison software can perform this function. If the computer software determines that the test pattern matches the expected pattern, printing can continue. Such a comparison can be set to run periodically, for example, every few minutes to once an hour depending on the job and print-head reliability. So long as the software determines that the test pattern adequately matches the predetermined color pattern, the printer can be allowed to continue to print. If, however, the software determines that the features of the digital photograph of the color test pattern does not match the expected pattern within a predetermined tolerance, then one of two options may be carried out. For example, in a first option, a fault condition can be issued and printing may be paused. The fault condition can provide feedback, such as text on a display indicating what issue caused the pause (e.g., a missing dot, unusual dot size, etc.), according to the parameter determined to be outside of the predetermined tolerance. The user/operator could then clean/repair/replace the printhead, which could cause a resetting of the fault and allow printing to continue. In another option, the analysis software can be programmed to issue a fault condition which triggers an automatic self-cleaning cycle (if one is provided for the printer) in an attempt to automatically resolve a jetting issue without the need for manual intervention (for example, manual intervention in accordance to the first option). After such a cleaning cycle is completed, the test pattern can be re-tested to determine if the print head successfully repaired itself during the automatic self-cleaning cycle. Upon conclusion of a self-cleaning cycle, another test pattern can be printed and subject to creation of a corresponding color pattern. If the color pattern matches the predetermined color pattern according to the above description, the fault is reset and printing can continue. If the test pattern is determined by the software to not match the predetermined color pattern, then the same or another fault can be raised and printing would be paused. In another embodiment, test strip can be marked with an identifier, such as a numeric or graphic tag, logged in a database with a corresponding designator to cross-reference the identifier with a particular print job, and the test strip can be stored for further examination by an operator, if so desired. For example, the instructions can include activating the imaging system to detect the color pattern, such as color pattern 102, as color pattern data, and retrieving predetermined color pattern data stored in the at least one memory. Additionally, the instructions can include comparing the detected color pattern data and predetermined color pattern data. The instructions can further include activating an indicator to provide information about the detected color pattern data relative to the predetermined color pattern data.

In another embodiment, comparison of expected color pattern 106 against color pattern 102' can result in an audible and/or visual indication that the nozzle is functioning properly. For example, the system can determine that there either are no differences, or no substantial differences (i.e., the differences are within a predetermined tolerance) between the expected color pattern 106 and the color pattern 102' formed during system operation.

The color-changing material can be a solid or a liquid. The color-changing material can be any material that changes color upon exposure to at least one color-change inducer. In an embodiment, the at least one color-changing material can comprise a first phenol-formaldehyde compound. In an embodiment, at least one color change inducer can comprise a second phenol-formaldehyde compound. In an embodiment, the color-change inducer can be heat which can be delivered to the color-changing material by a heat source such as a radiant heater, and the color-changing material can be a thermochromic material. Thus, instead of a roller, 111 can be a heat source. The at least one color-changing material can comprise a first color-changing material that changes to a first color upon exposure to a first one of the at least one color-change inducer. The at least one color changing material can comprise second color-changing material that changes to a second color upon exposure to a second one of the at least one color-change inducer. It is noted that many different combinations of at least one color-changing compound and at least one color-change inducer can be utilized and that the embodiments described herein are not limited to any particular combination. In fact, embodiments can include various combinations of at least one color-changing compound and at least one color-change inducer such that when they contact one another they turn to at least one color on the visible-color spectrum. Accordingly, the at least one color-changing compound and at least one color-change inducer can be selected to turn red, blue, green, etc., upon being placed in contact with one another.

In some instances, the print head's nozzles may perform in a manner such that the jet-fault analysis system will determine that the resulting test pattern is unacceptable. For example, as illustrated in FIGS. 3A-3D, the print head can deposit printed material as test pattern 107'. In an example, the print head's nozzles may be fully or partially clogged such that they misfire or don't fire at all, which can result in imperfections, such as voids 109, where the test pattern is not continuous on the substrate 103. As color-change inducing material is delivered to the substrate, unprotected areas 103' of the substrate (i.e., portions of substrate not covered by print material 107') are activated to change color as described above. That is, the color change inducer activates the color-changing compound in unprotected portions of the substrate. The result is formation of a color pattern 104'. As the substrate is moved between the print head 105 and the imaging system 115, a scan or photograph of the resulting color pattern 104' can be taken and stored, for example in the system's memory. The photograph/image/scan of the resulting color pattern 104' can be compared to the expected or predetermined acceptable color pattern 106 of FIG. 4. As described above, if the jet fault analysis system determines that color pattern 104' is substantially different than the expected color pattern 106, it can provide a visual or audio indication that the test pattern is unacceptable and/or that the print head has experienced a malfunction.

In an embodiment, the print medium can comprise a polymer. In an embodiment the test pattern can comprise a test pattern formed of a predetermined number of dots. In an embodiment, a color test pattern formed on or over the test pattern can be compared to a predetermined color test pattern that has a predetermined diameter or range of diameters expected for the predetermined number of deposited dots. In an example, the number of dots may be in a range of 6 to 12 dots, and the predetermined diameter may be selected in the range of about 137 to about 163 microns.

In an embodiment, the substrate can comprise a strip of substrate removed from a larger portion of substrate. For example, the carrier material of the substrate can comprise a perforated piece of paper or fabric removed from a plurality of perforated sheets of paper or fabric connected together to form a stack or a roll, and separable from one another via perforations. The substrate can be reusable or single-use/throw-away.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function.

Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following:

either A, B, or C alone; or combinations of two, such as A and B, B and C, and A and C; or combinations of three A, B and C.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A jetting-fault analysis system comprising:

a print head with a plurality of nozzles for ejecting a print medium onto a testing substrate;

a testing substrate comprising a carrier and further comprising a first color-changing material and a second color-changing material dispersed throughout the carrier, an applicator for delivering at least one color-change inducer to the testing substrate; and an imaging system for analyzing color-contrast patterns of the substrate, wherein the first color-changing material changes to a first color upon exposure to the at least one color-change inducer, and wherein the second color-changing material changes to a second color upon exposure to the at least one color-change inducer.

2. The system of claim 1, wherein the print medium comprises a polymer.

3. The system of claim 1, wherein the carrier comprises a perforated strip.

4. The system of claim 1, wherein the at least one color-changing material comprises a phenol-formaldehyde compound.

5. The system of claim 1, wherein the at least one color-change inducer comprises a phenol-formaldehyde compound.

6. The system of claim 1, wherein the applicator comprises a roller, a brush, a pad, or a stamp.

7. The system of claim 1, further comprising a transporter that moves the substrate from a test pattern printing area to a color pattern analysis area.

8. The system of claim 1, wherein the imaging detection system comprises a camera.

9. The system of claim 1, wherein portions of the testing substrate are protected from exposure to the at least one color-change inducer.

10. A method for performing a jetting-fault analysis, comprising:

forming a test pattern on a testing substrate by ejecting a print medium from at least one of a plurality of nozzles of a print head onto the testing substrate, wherein the testing substrate comprises a carrier and further comprises a first color-changing material and a second color-changing material dispersed throughout the carrier; and forming a color pattern by exposing at least one of the first color-changing material and the second color-changing material of the substrate to at least one color-change inducer, wherein portions of the substrate underlying the test pattern are not penetrated by the at least one color-change inducer, and wherein the first color-changing material changes to a first color upon reacting with the at least one color-change inducer, and wherein the second color-changing material changes to a second color upon reacting with the at least one color-change inducer.

11. The method of claim 10, further comprising:

providing at least one memory to store data and instructions;

providing at least one processor configured to access the at least one memory and to execute instructions, the instructions comprising:

activating an imaging system to detect the color pattern as color pattern data;

retrieving predetermined color pattern data stored in the at least one memory;

comparing the detected color pattern data and predetermined color pattern data;

activating an indicator to provide information about the detected color pattern data relative to the predetermined color pattern data.

12. The method of claim 10, wherein the print medium comprises a polymer.

13. The method of claim 10, wherein the carrier comprises a perforated strip.

14. The method of claim 10, wherein the at least one color-changing material comprises a first phenol-formaldehyde compound.

15. The method of claim 10, wherein the at least one color-change inducer comprises a phenol-formaldehyde compound.

16. The method of claim 10, wherein an applicator delivers the color-change inducer to the testing substrate and comprises a roller, a brush, a pad, or a stamp.

17. The method of claim 10, wherein a transporter moves the substrate from a test pattern printing area to a color pattern analysis area.

18. The method of claim 10, further comprising an imaging system with a camera that photographs the color pattern.

19. A method for performing a jetting-fault analysis, comprising:

forming a test pattern on a testing substrate by ejecting a print medium from at least one of a plurality of nozzles of a print head onto the testing substrate, wherein the testing substrate comprises a carrier and at least one color-changing material dispersed throughout the carrier; and forming a color pattern by exposing the at least one color-changing material of the substrate to at least one color-change inducer, wherein portions of the substrate underlying the test pattern are not penetrated by the color-change inducer, and wherein the at least one color-change inducer comprises a phenol-formaldehyde compound.

* * * * *